US008714148B2

(12) United States Patent
Götzendorfer et al.

(10) Patent No.: US 8,714,148 B2
(45) Date of Patent: May 6, 2014

(54) LOCKING APPARATUS FOR LOCKING A COOKING DEVICE DOOR

(75) Inventors: Franz Götzendorfer, Traunstein (DE); Hans Lappat, Garching a.d. Alz (DE); Andreas Mayr, Breitbrunn am Chiemsee (DE)

(73) Assignee: BSH Bosch und Siemens Haugeraete GmbH, Munich (DE)

( * ) Notice: Subject to any disclaimer, the term of this patent is extended or adjusted under 35 U.S.C. 154(b) by 1149 days.

(21) Appl. No.: 12/227,317

(22) PCT Filed: May 22, 2007

(86) PCT No.: PCT/EP2007/054923

§ 371 (c)(1), (2), (4) Date: Nov. 12, 2008

(87) PCT Pub. No.: WO2007/137965

PCT Pub. Date: Dec. 6, 2007

(65) Prior Publication Data

US 2009/0235913 A1 Sep. 24, 2009

(30) Foreign Application Priority Data

Jun. 1, 2006 (DE) ..... 10 2006 025 701

(51) Int. Cl.
*F24C 15/02* (2006.01)

(52) U.S. Cl.
USPC ..... 126/197; 292/194; 292/DIG. 69

(58) Field of Classification Search
USPC ..... 126/192, 197; 219/393, 412, 413, 490; 292/1, 194, DIG. 69
See application file for complete search history.

(56) References Cited

U.S. PATENT DOCUMENTS

| | | | | |
|---|---|---|---|---|
| 3,735,750 | A | 5/1973 | Detterbeck et al. | |
| 4,105,229 | A * | 8/1978 | Kaldenberg | 292/113 |
| 4,374,320 | A | 2/1983 | Barnett | |
| 5,029,910 | A * | 7/1991 | Genbauffe et al. | 292/110 |
| 5,220,153 | A * | 6/1993 | Malone et al. | 219/412 |
| 6,022,056 | A * | 2/2000 | Cope et al. | 292/144 |
| 6,930,284 | B2 | 8/2005 | Kang | |
| 2005/0173932 | A1 * | 8/2005 | Lomicka et al. | 292/201 |
| 2005/0200137 | A1 * | 9/2005 | Nelsen et al. | 292/201 |
| 2005/0248163 | A1 * | 11/2005 | Kim | 292/201 |
| 2005/0284464 | A1 * | 12/2005 | Edwards et al. | 126/197 |

FOREIGN PATENT DOCUMENTS

DE 30 25 730 1/1982

(Continued)

OTHER PUBLICATIONS

International Search Report PCT/EP2007/054923.

*Primary Examiner* — Craig Schneider
*Assistant Examiner* — Kevin Murphy
(74) *Attorney, Agent, or Firm* — James E. Howard; Andre Pallapies

(57) ABSTRACT

A locking apparatus for locking a cooking device door is provided that includes a locking element, a motor for moving the locking element, and a stop in the cooking device door which restricts the movement of the locking element in a locking position. In order to provide a locking apparatus for locking a cooking device door with improved properties in terms of reliability of the lock, the locking apparatus includes a device for detecting a core variable for a movement path covered by the locking element.

15 Claims, 2 Drawing Sheets

(56) References Cited

FOREIGN PATENT DOCUMENTS

| | | |
|---|---|---|
| DE | 44 43274 | 6/1996 |
| DE | 195 47 577 | 6/1997 |
| DE | 198 19 611 | 11/1999 |
| DE | 202 02 990 U | 9/2002 |
| EP | 0 147 549 | 7/1985 |
| EP | 0 348 319 | 12/1989 |
| EP | 1 580 359 | 9/2005 |
| GB | 1 457 579 | 12/1976 |

* cited by examiner

LOCKING APPARATUS FOR LOCKING A COOKING DEVICE DOOR

BACKGROUND OF THE INVENTION

The invention is based on a locking apparatus for locking a cooking device door in accordance with the preamble of claim 1 and a method for locking a cooking device door in accordance with the preamble of claim 13.

Locking apparatuses for locking a cooking device door are known from the prior art, especially in the conjunction with cooking devices with pyrolysis facilities. Such locking apparatuses comprise a locking element, a motor for moving the locking element and a stop in the cooking device door, which restricts the movement of the locking element in a locking position.

BRIEF SUMMARY OF THE INVENTION

The object of the invention is especially to provide a generic locking apparatus or a method for locking a cooking device door with improved characteristics as regards security of the locking. The locking apparatus or the method should especially guarantee during a pyrolysis process that the cooking device door is correctly locked or should automatically and reliably detect incorrect locking.

The object is achieved inventively by the features of claims 1 and 13, while advantageous embodiments and developments of the invention can be taken from the subclaims.

The invention is based on a locking apparatus for locking a cooking device door, comprising a locking element, a motor for moving the locking element and a stop in the cooking device door which restricts the movement of the locking element in a locking position.

It is proposed that the locking apparatus has a means which is provided for detecting a core variable for a movement path covered by the locking element. Detecting the movement path enables a check to be made as to whether a movement of the locking element corresponding to the movement of the motor has taken place. This allows a blocking of the locking element and a movement of the locking element beyond the locking position to be detected. In both cases the cooking device door has not been securely locked. In the first case the locking apparatus, as a result of a fault or of contamination, is not fully engaged, and in the second case the stop and thereby the cooking device door is not at the correct position and can thus not be locked.

The inventive solution also enables a cooking device including the cooking device door to be operated more safely, since the correct locking of the cooking device door during the execution of programs, for example a pyrolysis program, which make it necessary to lock the door for safety reasons, can be verified.

"Movement path" in this context is to be referred to as a path-independent distance between a starting position and an ending position of the locking element in relation to a predetermined time interval.

"Cooking device" in this context refers to any usual device for cooking foodstuffs, especially an oven or a microwave. An increase in operational safety is especially able to be achieved in connection with devices with pyrolysis capabilities, for which locking of the cooking device door during of the pyrolysis process is a statuary requirement.

"Provided" in this context should also be taken to mean "designed" and "equipped". The means for detecting a core variable for a movement path covered by the locking element can be implemented, depending on the nature of the movement, as a rotation sensor, as a distance sensor or also purely electronically or as software.

If the means for detecting the locking of the locking element is suitable, in addition to the general function of the locking apparatus, the locking status itself can also be checked directly.

A compact design of locking apparatus can be achieved if the movement of the locking element is a rotational movement.

A direct detection of the movement path by a sensor, generator or suchlike can be dispensed with if the means sets the core variable in relation to an operating time of the motor. The means can in this case be advantageously integrated into motor control electronics.

If the motor is a synchronous motor, the number of revolutions of the motor and thereby the movement path covered by the locking element can be directly deduced from the operating time of the motor.

A position of the locking element can be deduced directly from the distance covered, if the locking apparatus has a position detection means for automatic detection of a position of the locking element. The position detection means can for example also be used after a power outage for determining an absolute reference position.

If the position detection means is designed to detect whether the locking element is located at a predetermined position interval before an outermost locking position, locking can be guaranteed with a closed cooking device door. The position interval can especially be contained in an area in which the cooking device door is still safely locked despite a slight deviation of the outermost locking position.

If the means is provided for using the value of the core variable detected as a criterion for the start of a pyrolysis process, the start can be avoided with a cooking device door which is not safely locked or if the locking apparatus is not functioning correctly.

A constructively simple locking apparatus with good cleaning characteristics can be provided if the locking element is provided to engage in a corresponding locking element of the cooking device door.

If the locking apparatus comprises a motor control means for automatically stopping the motor after a predetermined time a synchronization of the position of the locking element reached with a setpoint position enables the correct function of the locking apparatus to be verified. This applies especially if the motor is embodied as a synchronous motor which has the characteristic of changing its direction of rotation if a load of the motor exceeds a critical value because of the fact that the locking element has reached the stop.

If the time interval is greater than a time interval in which the motor moves the locking element from a position at the beginning of the time interval into the locking position it can be ensured that the locking position has been reached or exceeded, whereby in the latter case the stop and along with it the cooking device door would not be in their place.

An acceptable duration of a locking process on the one hand and the locking element going beyond an interval in which the cooking device door is locked on the other hand can be avoided if the time interval is smaller than double the time interval in which the motor moves the locking element from a position at the beginning of the time interval into the locking position. The locking element going beyond the interval can be avoided here because of the change of direction which occurs especially in connection with synchronous motors.

The invention further relates to a method for locking a cooking device door by means of a movable locking element driven by a motor, the mobility of which in a locking position is restricted by a stop.

It is proposed that a core variable for a movement path covered by the locking element be detected. By detecting the movement path, as with the inventive locking apparatus, a check can be made as to whether a movement of the locking element really corresponding to the movement of the motor is taking place. This allows a blocking of the locking element and a movement of the locking element beyond the locking position to be detected.

Further advantages emerge from the description of the drawing given below. The drawing shows an exemplary embodiment of the invention. The drawing, the description and the claims contain numerous features in combination. The person skilled in the art would expediently also consider the features individually and combine them into further sensible combinations.

DETAILED DESCRIPTION OF THE PRESENT INVENTION

Figure 1:
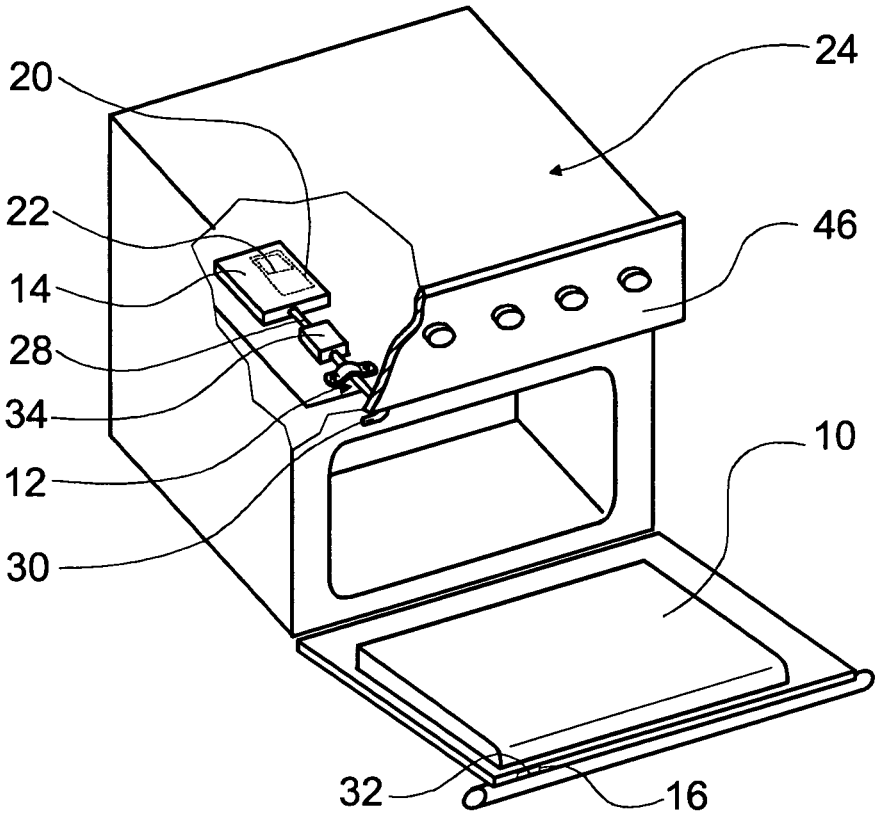
FIG. 1 a locking apparatus for locking a cooking device door, comprising a locking element, a motor for moving the locking element and a stop in the cooking device door, FIG. 2 the locking element from FIG. 1 as well as a corresponding locking element of the locking apparatus from FIG. 1 in a detailed diagram and FIG. 3 a schematic diagram of different position intervals as claimed in an inventive method for locking the cooking device door.
Figure 2:
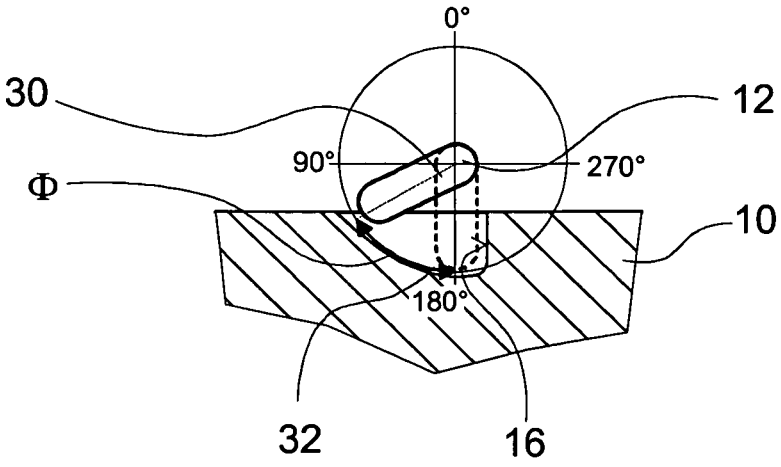

FIGS. 1 and 2 show a locking apparatus for locking a cooking device door 10, comprising a locking element 12, a motor 14 for moving the locking element 12 and a stop 16 (FIG. 2) in the cooking device door 10 which restricts the movement of the locking element 12 in a locking position 18.

The locking apparatus has a motor control means 20, which on the one hand comprises a means 22 for detecting a core variable Φ for a movement path covered by the locking element 12. A cooking device 24 including the locking apparatus is embodied in the present exemplary embodiment as a domestic oven and is equipped with a pyrolysis function and the means 22 checks and controls the locking apparatus which is actuated automatically during the pyrolysis.

The motor control means 20 includes an internal timer and can thus be used to automatically stop the motor 14 after a predetermined time interval 26.

The cooking device door 10 can be pivoted around a pivot axis running horizontally in the operating state of the cooking device door 24 at a lower edge of a muffle opening of the cooking device door 24.

The means 22 or the detection of a core variable Φ enables the operating safety of a cooking device 24 including the cooking device door 10 to be enhanced, since the correct locking of the cooking device door 10 can be verified during the execution of programs, for example a pyrolysis program, which require the door to be locked for safety reasons.

The locking element 12 essentially consists of a shaft 28 which, with the cooking device door 10 closed, runs perpendicular to the plane of the door with a locking hook 30 bent perpendicularly away from the shaft 28. The locking element 12 is able to be rotated around an axis of rotation identical to the longitudinal axis of the shaft 28 on a body of the cooking device door 24 including the locking apparatus, so that the movement of the locking element 12 controlled and checked by the means 22 is a rotational movement.

On its upper edge in the closed state in the operating configuration the cooking device door 10 has an oval recess open to the top which forms a corresponding locking element 32. By arranging the locking hook 30 in the area of the corresponding locking element 32 the locking element 12 is provided for engaging in the corresponding locking element 32 of the cooking device door 10.

The motor 14 of the locking apparatus is a synchronous motor which is connected directly to the shaft 28 of the locking element 12, so that whenever the shaft 28 can be turned without resistance, a duration of the motor operation or an operating time of the motor 14 is directly proportional to the movement path or rotation path of the locking element 12 covered in the observed time interval 26.

In the present exemplary embodiment the means 22 sets the operating time of the motor 14 in relation to the core variable Φ for a movement path covered by the locking element 12.

The shaft 28 of the locking element 12 is equipped with a position detection means 34 embodied as a switching shaft for automatic detection of a position of the locking element 12, in which a number of switching cams or switching tracks, each extending over an angular range make it possible to detect and verify the position of the locking device.

Figure 3:
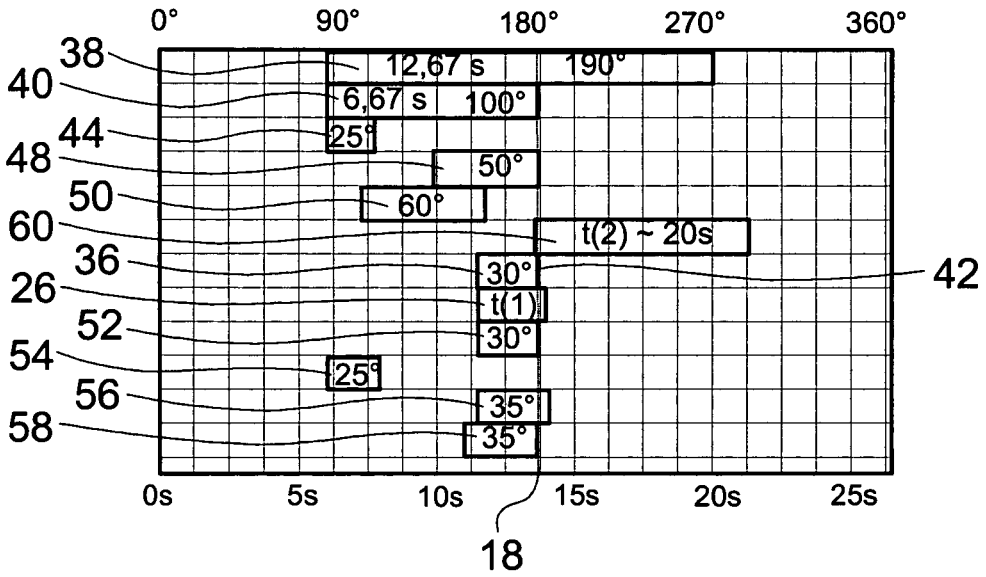

The function of the individual switching cams or switching tracks is explained below with reference to FIG. 3.

A first switching track 36 extends over an angular range in which the locking element 12 or its locking hook 30 has an angle of between 135° and 185° to a direction pointing vertically in FIG. 1. Through this switching track 36 the position detection means 34 is embodied so as to detect whether the locking element 12 is located at a predetermined position interval before the locking position. The locking position is at 185°.

If a switch assigned to this first switching path 36 is active and if it is also ensured in accordance with a method detailed further below that the cooking device door 10 is completely closed, the cooking device door 10 is safely locked, so that the means 22 is also designed for detecting the locking state of the locking element 12.

The value of the detected a core variable Φ is thus included in the detection of the locking state. The means 22 uses the recognized locking state as a criterion for the start of a pyrolysis process.

If the means 22 has detected that the cooking device door 10 and the stop 16 were not in place, the motor control means 20 moves the locking element 12 back into an initial position at 90°.

FIG. 2 further shows a maximum position interval 38 which corresponds to the maximum movement play of the locking element 12 without door. At the left-hand and right-hand end shown in FIG. 2 the maximum position interval 38 at 85° is restricted by the locking element 12 coming to a stop against a panel 46 of the cooking device 24.

In a similar manner a second position interval 40 is shown which corresponds to the maximum movement play of the locking element 12 with a closed cooking device door 10. At the left-hand end in FIG. 2 the second position interval 40 at 85° is restricted by the locking element 12 being stopped by the panel 46 of the cooking device 24, while the second position interval 40 is restricted at its right-hand end by the locking hook 30 of the locking element 12 stopping at the stop 16 with a closed cooking device door 10.

Furthermore a third position interval 44 specifies an area in which the cooking device door 10 is securely open or can be opened without problems as a result of the finite width of a gap between the panel 46 and the front edge of the cooking device door 10.

In addition a fourth position interval 48 specifies an angular range in which the cooking device door 10 is safely locked, a fifth position interval 50 is entered for a self-locking switching path not to be dealt with in any greater detail here.

A further position interval extends over 30° before the locking position 18 and corresponds to the first switching path 36 as well as a further position interval which is assigned to a switching path for activating a rod protector used during pyrolysis.

Also shown are a first electronics output 54 of the motor 14, in which a locking process can be started, a second electronics output 56 of the motor in which an unlocking process can be started and a third electronics output 58 of the motor 14, to which a time control described below is assigned.

In a method for locking the cooking device door 10 by means of the movable locking element 12 driven by the motor 14, of which the movability in the locking position 18 is limited by the stop 16, a core variable Φ for a movement path covered by the locking element 12 is detected and used for checking the locking of the cooking device door 10.

The method begins with the locking process when the rotational position of the locking element 12 lies within the third position interval 44. The motor 14 begins to run and turns the locking element 12.

If the locking element 12 reaches the first switching path 36, a control timer begins which lets the motor 14 continue to run for a time interval 26 of 2.33 seconds. The time interval 26 is greater than a time interval 42 of 2 seconds in which the motor 14 moves the locking element 12 out of the position at the beginning of the time interval 26 or 42 into the locking position 18.

The time interval 42 corresponds to the time that motor 14 with a given AC frequency, needs a supply voltage to move the locking element 12 or the corresponding switching cam of the position detection means 34 via the switching path 36, i.e. the time interval 42 of 2 seconds corresponds through the constant speed of the motor 14 embodied as a synchronous motor to the length of the first switching path.

The length of the time interval 26 of 2.33 seconds is smaller than that of double the length of the time interval 42 of 2 seconds in which the motor 14 moves the locking element 12 from a position at the start of the time interval 26 into the locking position 18.

If the cooking device door 10 is closed, the locking hook 30 of the locking element 12 after the time interval 42 of 2 seconds hits the stop 16 of the locking apparatus. The large resistance causes the motor 14 embodied as a synchronous motor to change its direction until the motor control means 20 automatically switches off the motor 14 after the end of the time interval 26 of 2.33 seconds. The position detection means 34 detects that the locking element 12 is still in the first switching path 36.

However if the cooking device door 10 during of the locking process, the motor 14, because of the absence of the stop 16, turns the locking element 12 beyond the locking position 18 until the time interval 26 of 2.33 seconds has ended.

Since a switch assigned to the first switching path 36 is now open, and since the locking element 12 has left the position assigned to the first switching path 36, the means 22 detects from the state of this switch after execution of the time interval 26 of 2.33 seconds whether the cooking device door 10 or the stop 16 was present or not. Through the state of the switch an angle is explicitly detected by which the locking element 12 has effectively turned during the time interval 26. This angle forms a core variable Φ for a movement path covered by the locking element 12.

A further control timer with a time interval 60 of 20 seconds begins to run when the locking element 12 has left the first switching path 36. It is designed to prevent the motor 14 continuing to rotate endlessly after a serous fault of the cooking device door 24.

REFERENCE SYMBOL

10 Cooking device door Φ Core variable
12 Locking element
14 Motor
16 Stop
18 Locking position
20 Motor control means
22 Means
24 Cooking device
26 Time interval
28 Shaft
30 Locking hook
32 Locking element
34 Position detection means
36 Switching path
38 Position interval
40 Position interval
42 Time interval
44 Position interval
46 Panel
48 Position interval
50 Position interval
52 Position interval
54 Electronics output
56 Electronics output
58 Electronics output
60 Time interval

The invention claimed is:

1. A method for locking a cooking device door via a mobile locking element driven by a motor, the method comprising:

moving a locking element along a movement path, the locking element being movable along the movement path in both an instance in which the cooking device door is in a locking position, whereupon the locking element is operable to lock the cooking device door, and in an instance in which the cooking device door is not in a locking position, whereupon the locking element does not lock the cooking device door, and, in those instances in which the cooking device door is in a locking position, the locking element being restricted from further movement along the movement path by a stop in the cooking device door that extends into the movement path; and detecting the position of the locking element along the movement path based on an operating time of the motor, wherein the operating time of the motor is measured after the locking element has passed an intermediate position of the movement path.

2. The method according to claim 1 and further comprising evaluating the position as a criterion for starting a pyrolysis process.

3. The method according to claim 1, further comprising automatically stopping the locking element after a predetermined time interval.

4. The method according claim 3, wherein the predetermined time interval is greater than a time interval in which the locking element from a position at the beginning of the time interval into the locking position.

5. The method according to claim 4, wherein the predetermined time interval has a length smaller than double the length of the time interval in which the locking element moves from a position at the beginning of the time interval into the locking position.

6. The method according to claim 1, wherein the position of the locking element is detected based on a calculation using the operating time of the motor.

7. A locking apparatus for locking a cooking device door, the locking apparatus comprising:

a locking element;

a motor for moving the locking element along a movement path;

a motor control comprising at least a timer;

a stop adapted to be positioned in the cooking device door, the stop operating to restrict further movement of the locking element along the movement path in a locking position;

a switching track associated with a position interval of the movement path, the position interval extending from a first predetermined position to the locking position, the first predetermined position being an intermediate position of the movement path;

the motor control being configured to stop the motor at an expiration of a predetermined time interval so that the locking element stops in a locked position, the predetermined time interval being configured to commence when the locking element reaches the first predetermined position; and the switching track being configured to detect whether the locking element is located within the position interval.

8. The locking apparatus as claimed in claim 7, wherein the switching track is designed for evaluating a locking state of the locking element in dependence on the position of the locking element along the movement path.

9. The locking apparatus as claimed in claim 7, wherein the motor is a synchronous motor.

10. The locking apparatus as claimed in claim 7, wherein the switching track is configured to automatically detect the position of the locking element.

11. The locking apparatus as claimed in claim 10, wherein the switching track is operable to detect whether the locking element is located in a predetermined position interval before the locking position.

12. The locking apparatus as claimed in claim 7 and further comprising means for evaluating the position as a criterion for starting a pyrolysis process.

13. The locking apparatus as claimed in claim 7, wherein the locking element is operable to engage in a corresponding locking element of the cooking device door.

14. A cooking appliance comprising:

a main body;

an appliance door, wherein the appliance door is movably attached to the main body; and the locking apparatus of claim 7.

15. A method for securely locking a cooking device door via a mobile locking element driven by a motor, the method comprising:

moving a locking element along a movement path via a motor toward a stop, the movement path comprising a switching track, the switching track extending over a locking position interval, the locking position interval extending from a first predetermined position to an outermost locking position at the stop, and the locking position interval corresponding to a positional range along the movement path in which the locking element is safely locked even if not at the outermost locking position;

triggering a preset time interval via a timer associated with a motor control when the locking element reaches the first predetermined position;

automatically stopping the motor at the expiration of the preset time interval via the motor control such that the locking element stops at a second position;

automatically detecting the second position of the locking element along the movement path based on a distance traveled from the predetermined position interval to the second position during the predetermined time interval; and evaluating the locking status of the locking element by automatically detecting whether the locking element is located within the locking position interval via the switching track, wherein the cooking device door is considered securely locked if the locking element is located within the locking position interval at the expiration of the preset time interval.

* * * * *

UNITED STATES PATENT AND TRADEMARK OFFICE

CERTIFICATE OF CORRECTION

PATENT NO. : 8,714,148 B2
APPLICATION NO. : 12/227317
DATED : May 6, 2014
INVENTOR(S) : Götzendorfer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1241 days.

Signed and Sealed this
Twenty-ninth Day of September, 2015

Michelle K. Lee

Michelle K. Lee
*Director of the United States Patent and Trademark Office*